United States Patent [19]

Patterson

[11] 4,112,526

[45] Sep. 12, 1978

[54] WATER LEVEL CONTROLLER FOR SWIMMING POOL GUTTER

[76] Inventor: James A. Patterson, 2375 Valleyview Dr., Columbus, Ohio 43204

[21] Appl. No.: 772,732

[22] Filed: Feb. 28, 1977

Related U.S. Application Data

[60] Continuation of Ser. No. 653,512, Jan. 29, 1976, abandoned, which is a division of Ser. No. 592,950, Jul. 3, 1975.

[51] Int. Cl.[2] ..... E04H 3/20

[52] U.S. Cl. ..... 4/172.17

[58] Field of Search ..... 4/172, 172.15, 172.16, 4/172.17, 172.18, 172.19, 172.21; 61/22 A, 25, 28; 137/409, 426, 433, 451; 210/169; 138/105

[56] References Cited

U.S. PATENT DOCUMENTS

| | | | |
|---|---|---|---|
| 3,212,268 | 10/1965 | Ortega | 61/28 |
| 3,252,576 | 5/1966 | Miller | 210/169 X |
| 3,616,468 | 11/1971 | Takacs | 4/172.15 |
| 3,668,713 | 6/1972 | Baker | 4/172.17 |
| 3,815,160 | 6/1974 | Baker | 4/172.17 |
| 3,908,207 | 9/1975 | van den Broek | 4/172.17 |
| 3,939,505 | 2/1976 | Gross | 4/172.17 |

FOREIGN PATENT DOCUMENTS

| | | | |
|---|---|---|---|
| 1,174,063 | 12/1969 | United Kingdom | 4/172.21 |

*Primary Examiner*—Richard E. Aegerter
*Assistant Examiner*—Stuart S. Levy
*Attorney, Agent, or Firm*—Wood, Herron & Evans

[57] ABSTRACT

A pool having a gutter around its perimeter, the gutter being formed in part by an inner lip. Openings spaced around the perimeter of the pool are formed in the inner lip, and means are provided to close the openings when the water level in the gutter reaches a predetermined level. Optionally, a conduit is located below the gutter and is connected to the suction side of a pump. Selectively closable holes in a wall common to the gutter and conduit form a communication between the conduit and gutter.

2 Claims, 8 Drawing Figures

WATER LEVEL CONTROLLER FOR SWIMMING POOL GUTTER

This is a continuation of application Ser. No. 653,512, filed Jan. 29, 1976 now abandoned, which is a division of Ser. No. 592,950, filed July 3, 1975.

This invention relates to swimming pools, and more particularly, the invention is directed to the combination of a gutter around the perimeter of the pool and a plurality of automatically regulated skimmers connecting the pool to the gutter.

The invention is directed to swimming pools generally of the type wherein the swimming pool tank is surrounded by a gutter at the top of the walls forming the tank. That type of pool is particularly desirable for large municipal type installations, particularly where competitive swimming will be involved. The pool is particularly desirable for competitive swimming because of the use of the gutter and the coping by which the gutter is formed. The gutter receives surges of water generated by the competitive swimming and permits the surges of water to be conveyed to the filter system without splash back into the pool. Such pools are regarded as "fast" pools by swimmers because the absence of splash back causes less resistance to the movement of the swimmer through the pool.

Such pools have been provided with skimmers, that is, openings in the inner gutter wall which permit flow of pool water into the gutters without having to raise the water level to overflow the gutters. The skimmers provide a continuous flow of water into the gutters in times when the pool is in a quiescent state.

Three objectives are desired to be attained by the skimmers. First, the maintenance of a flow of the water from the pool through the skimmers into the gutter tends to keep the pool clean of floating debris and scum.

Second, the flow of water through the skimmers tends to keep the gutters supplied with water which flows to the filter, thereby maintaining the gutters themselves clean.

Third, the gutters themselves provide capacity to receive the surge of water, without splash back or flooding, during periods of high activity.

A number of attempts have been made to achieve all three objectives, but none has been entirely satisfactory.

One attempt has been the use of a floating weir in the skimmer opening which, with its floating action, tends to close the skimmer opening as the water level in the pool rises. The problem with the floating weir is that it does not close the opening until the gutter is full of water. A full gutter is an undesirable condition since a full gutter provides no capacity to accommodate surges. Further, since the floating weir is dependent on the level of water in the pool, it necessarily reacts to choppy water, bobbing up and down, and therefore does not close off the weir opening when it is necessary.

Another type of skimmer has been suggested which is adjustable to enable it to be closed during periods of high activity to provide greater gutter capacity and opened during quiescent stages in order to provide the desired skimming action. The principal disadvantage of this approach is that while it is adapted to accommodate the two different types of activity, it nevertheless must be hand operated. Since the degree of activity in a pool will vary greatly throughout a day, the need for continuously adjusting the skimmer is obviously a bother to the management.

Another approach has been simply to add to gutter capacity, but that approach necessarily adds to the cost of the pool.

The objective of the present invention has been to provide an improved skimmer which efficiently performs the desired skimming action but which automatically regulates the flow of water into the gutter so as to maintain it at a continuously supplied low level without permitting the gutter to be flooded.

Another objective of the invention has been to provide a plurality of skimmers spaced around the perimeter of the pool, the skimmers being set to close the weir at differing levels of water in the gutter around the pool. More particularly, the skimmers positioned remote from the gutter outlet into the filter are set to close the skimmer opening at a higher level in the gutter than those skimmers close to the gutter outlet. This arrangement causes a greater flow of water into the gutters at locations remote from the gutter outlet, thereby providing assurance that the water will flow from those remote locations at a greater velocity toward the gutter outlet.

The objectives of the invention are achieved by providing a weir opening and a float operated valve to close the opening, the float being located at a position in the gutter well below the skimmer opening so that an increase in the level of the water in the gutter to a point well below the top of the gutter will cause the skimmer to be closed.

Thus, the skimmer will be continuously and automatically operated to open on demand from the gutter and to close as soon as the gutter begins to fill. In quiescent periods, the skimmer will be more or less continuously open since the only flow into the gutter occurs through the skimmer. On the other hand, when activity in the pool grows to the extent that waves are continuously rolling over the inner gutter wall, the wave action itself will be sufficient to keep the gutters supplied with water and the skimmers will normally remain continuously closed, thereby providing assurance that the gutter capacity will be used substantially entirely to accommodate the wave action.

The skimmers discussed above are suitable for use with a gravity operated gutter. It has been another objective of the invention to provide a suction operated gutter where the water in the gutter is positively withdrawn by connecting it to the low pressure side of a pump to the filer. This feature of the invention is preferably used in conjunction with the skimmers, for the skimmers would be required to provide assurance that the gutter was continuously supplied with water, thus avoiding air entering the pump. Alternatively, the suction evacuated gutter could be used in a pool having no skimmers wherein the level of the pool was kept sufficiently high that water continuously overflowed the gutter wall to maintain a continuous supply of water into the gutter.

Another objective of the invention has been to provide a gutter and conduit system, the gutter having a conduit immediately below it, the gutter and conduit being separated by a common wall which, at least partly, forms the bottom wall of the gutter. Preferably, the common wall has a plurality of holes in it spaced around the perimeter of the pool through which water passes from the gutter to the conduit. Still further, means are provided to selectively plug certain of the communicating holes in the divider wall between the two stages.

The two stage system with the selectively closable communicating holes admits of a more uniform maintenance of the level of the water in the gutter. In conventional gravity flow gutters, there is a tendency for the water in that section of the gutter remote from the gutter outlet to flow more slowly than the water adjacent the gutter outlet and hence the water in the remote portions of the pool tends to remain somewhat stagnant.

In the two stage system, any area, in operation, which tends to accumulate water in the gutter can be cleared of the water by opening additional holes in the divider wall. This, of course, is set initially as will be described below and thereafter will be left alone with the system providing continuous regulation of the level of water in the gutter.

The several objectives and features of the invention will become more readily apparent from the following detailed description taken in conjunction with the accompanying drawings in which.

Figures 1, 8:
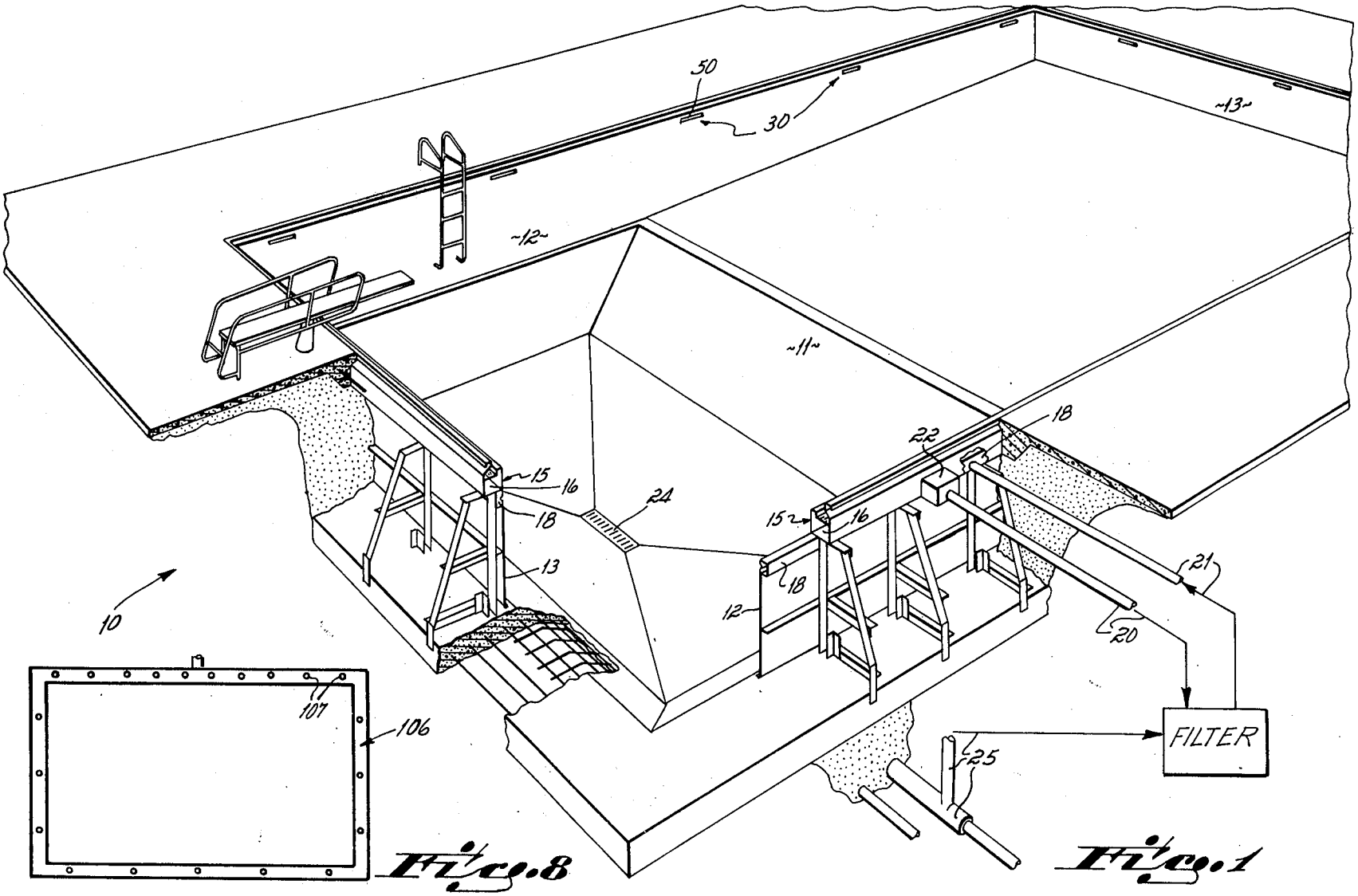
FIG. 1 is a diagrammatic perspective view of a pool incorporating the present invention.
FIG. 8 is a diagrammatic plan view of a swimming pool utilizing the two stage system.

Referring to FIG. 1, there is shown a swimming pool 10 having a bottom wall 11, side walls 12 and end walls 13. Mounted on the top of the side and end walls is a coping 15 creating a gutter 16. Immediately below the gutter forming coping is a wall formed conduit 18 around the pool, the conduit 18 having outlet openings spaced around the periphery of the pool for delivering filtered water to the pool. The wall formed gutter is disclosed in copending application Ser. No. 451,064, filed Mar. 14, 1974. The gutter 16 and the conduit 18 are connected to a filter by pipes 20 and 21. The pipe 21 delivers water under pressure to the conduit 18. The pipe 20 is connected by a box 22 to the gutter and in this embodiment receives water from the gutter as it flows by gravity along the gutter. Water may also be removed from the pool by a main drain 24 and delivered to the pool through pipe 25. Spaced around the perimeter of the pool as, for example, every 50 feet, are skimmers 30 which will be described in detail below.

Figure 2:
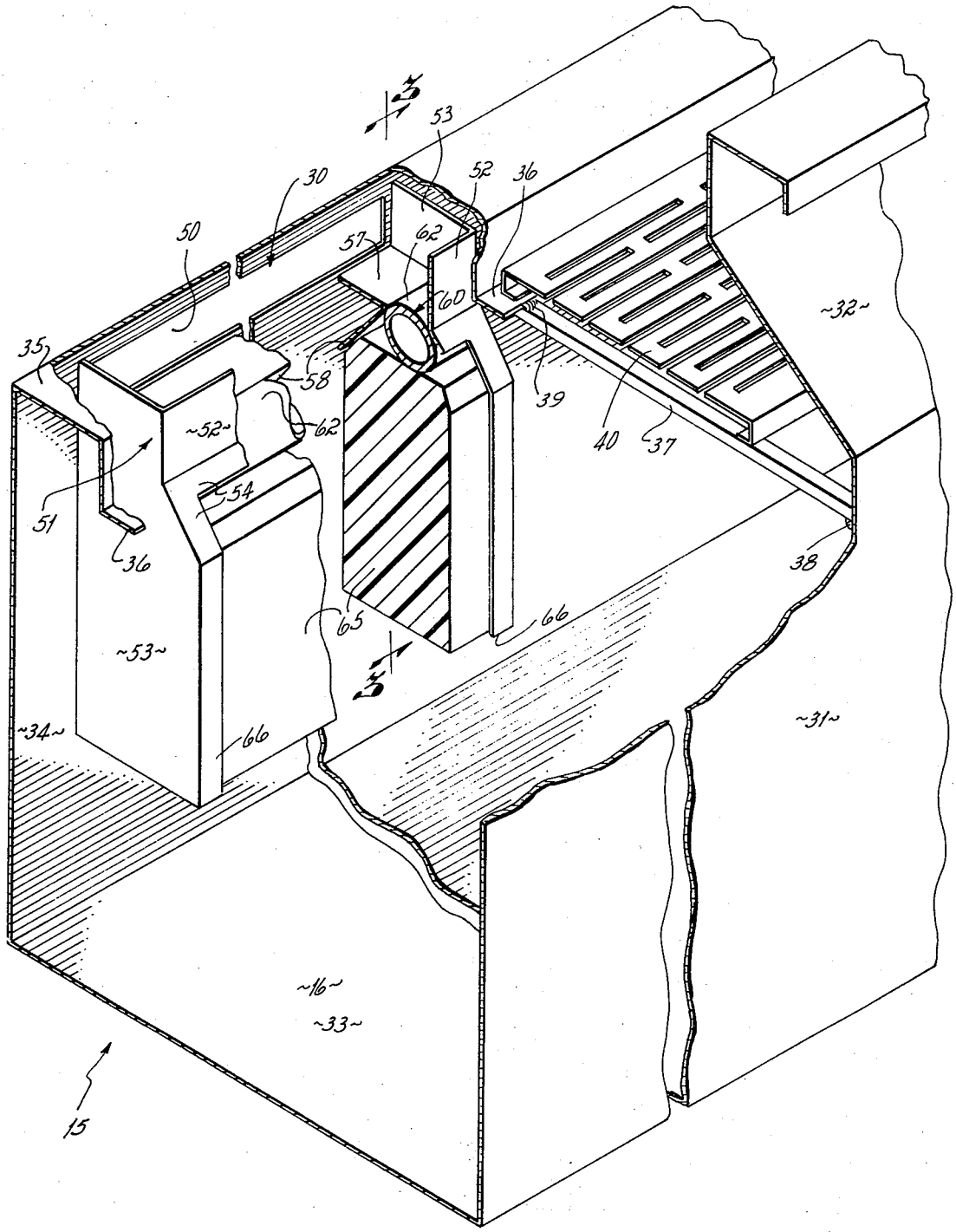
FIG. 2 is a perspective view partly in section of a skimmer of the invention.

As shown in FIG. 2, the gutter coping 15 has a back wall 31 which has an inwardly inclined upper portion 32 which causes waves splashed onto it to be driven down into the gutter. The coping also has a bottom plate 33 and an inner wall or lip 34. The inner wall 34 terminates in a generally U-shaped section 35 at its upper end which terminates in an outwardly projecting flange 36. Angle members 37 are secured across the gutter coping and are welded to the back wall at 38 and to the flange 37 at 39. A grating 40 is preferably placed across the angle members to prevent the swimmers getting their feet hung up in the gutter.

Figure 3:
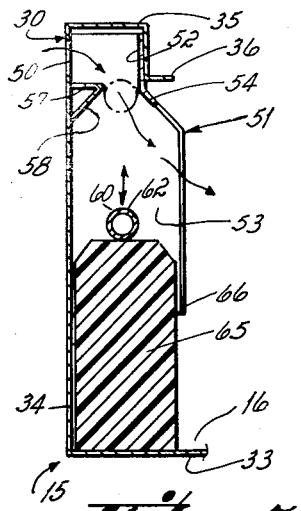
FIG. 3 is a cross-sectional view taken along lines 3—3 of FIG. 2.

One form of the skimmers which are spaced around the pool is shown in FIGS. 2 and 3.

The skimmer is formed by an elongated opening 50 cut in the front wall 34 of the gutter coping. The opening may be, for example, 12 inches long and 1 inch high. The opening is surrounded by a U-shaped housing 51 having a front wall 52 and side walls 53. The front wall 52 is outwardly flared at 54 to form one-half of a valve seat. A V-shaped member 57 extending the length of the skimmer housing is secured to the housing 51 or the front wall 34, or both. The lower surface 58 of the V-shaped member 57 forms the other half of the valve seat.

The valve is a tubular member 60 which extends the length of the housing 51, and its cylindrical surface 62 is adapted to seat against the valve seat members 54 and 58. The tubular member 60 freely rests upon a styrofoam float 65. The styrofoam float is slidable in depending L-shaped extensions 66 of the housing 51. The float and tubular valve are vertically slidable with respect to the housing and substantial space is permitted between the float and housing so as to avoid its being jammed during its normal operation. It is not critically important that the valve 60 form a watertight fit with respect to its seat 54, 58 and the end walls 53 of the housing since it is sufficient for operation simply to reduce the flow through the skimmer to a trickle. Furthermore, in resting freely on said float 65 the tubular member 60 is free to align itself with its seat 54, 58 regardless of the alignment of the float.

The vertical dimension of the float may be increased for the skimmers located in sections of the gutter close to the gutter outlet at 22. That will have the effect of causing those skimmers to close when the water in the gutter is shallower than the water in the gutter at the more remote area of the pool. Thus, under quiescent conditions, the water in the more remote areas will be deeper than the water in the areas close to the gutter outlet 22, thereby causing the water to flow "downhill" and have imparted to it a greater velocity than it would if all the skimmers closed at the same level of water.

In the operation of the skimmer of FIGS. 2 and 3, during quiescent conditions of water in the pool the skimmer valve would have dropped away from the valve seat, permitting water to flow through the opening 50 into the housing 51 and out through the space between the housing extensions 66. Continued flow of water into the gutter would soon cause the level of the water in the gutter to rise. As the level of the water in the gutter rises, the float 65 is raised to bring the valve tube 60 into engagement with the seat, thereby closing off the valve. At closing, the water in the gutter should fill no more than approximately two-thirds of the gutter, thereby leaving sufficient surge capacity. The desired level of water in the gutter at different locations around the perimeter of the pool may be altered to accommodate the system to the particular pool size, shape and normal degree of activity. With the closing of the valve, the water flowing in the gutter to the gutter outlet leaves the area of the skimmer, thereby causing the valve to reopen. Thus, the action of the valve continuously and automatically maintains water flowing in the gutter but at a desired low level.

In conditions of turbulence or considerable activity in the pool, the wave action in the pool will cause water to continuously slop over the lip or inner wall of the gutter and to pass through the grating into the gutter. During this condition, it is desired to close the skimmer so as to maintain as much surge capacity in the gutters as possible. This closing of the skimmer is automatically accomplished by the action of the flow described above.

In one form of operation of the pool, the level of the pool water is maintained slightly above the lip of the gutter so that water continuously flows into the gutter over the inner wall. This type of operation is permitted by the skimmers of the present invention, for under those conditions the level of the water in the gutters will normally maintain the skimmers continuously closed. If a slight overflow is the desired normal condition when a great number of swimmers is in the pool, in quiescent conditions the level of the water may be slightly below the lip or front wall of the gutter. Under such conditions, the skimmers will operate to maintain a skimming action and maintain a continuous supply of water to the gutters.

Figure 4:
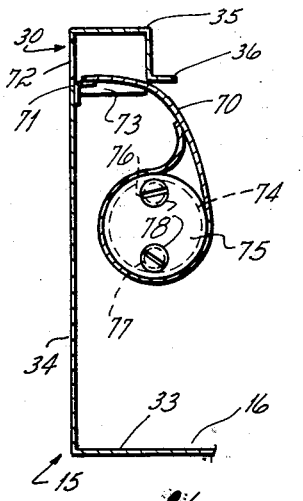
FIG. 4 is a cross-sectional view of an alternative embodiment of the skimmer.

An alternative form skimmer is illustrated in FIG. 4. The concept of the skimmer of FIG. 4 is the same as that described above except that the mechanism for valving the skimmer is different. In FIG. 4, a curved plate 70 is connected by a hinge 71 to the inner wall 34 of the gutter. Above the plate 70 an elongated hole 72 is formed in the inner wall through which water from the pool can flow into the gutter. The plate 70 extends across the inverted U-shaped portion 35 of the inner wall 34 and is engageable with the flange 36 so as to seat there and close off the flow from the opening 72 into the gutter. Vertical plates 73 are welded to the front wall 34 to form, with the U-shaped portion 35, a closed chamber above the hinged plate 70. A plastic tube 74 is secured to the plate 70, the tube 74 extending well down into the gutter. The tube has end caps 75 which close the tube. One end cap has an upper filling opening 76 and a lower draining opening 77 through which water or other flowing medium (sand or shot) can be introduced or drained. The openings are normally plugged by threaded plugs 78. The amount of medium in the tube will determine when the valve closes, that is, will determine the level of water which must be in the gutter to close the valve.

The operation of the skimmers of FIG. 4 is similar to that of FIGS. 2 and 3 except that instead of a vertically sliding valve, in FIG. 4 the valve swings about the hinge 71 between a closed position wherein the plate 70 engages the lip 36 and an open position wherein the plate will swing down away from the lip 36.

Figure 5:
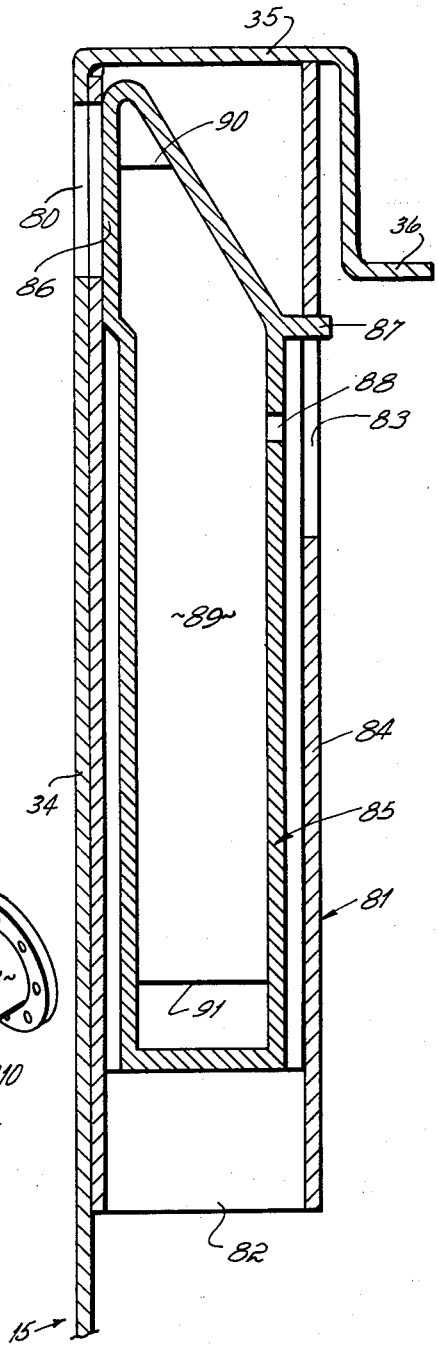
FIG. 5 is a cross-sectional view of still another alternative embodiment.

Still another embodiment of the valve is illustrated in FIG. 5. There the front wall 34 of the gutter has a skimmer opening 80 adjacent its upper edge. A skimmer box 81 surrounds the opening 80. The box is open at its bottom 82 and has an opening 83 in a wall 84 which is spaced from the front wall 34 of the gutter. A hollow float 85 is loosely fitted in the box 81 and is vertically slidable within the box. The float 85 has a front face 86 which acts as a valve seating against the opening 80 through the front wall of the gutter 34. The float has a flange 87 projecting through the opening 83 of the box 81 to limit the extent of vertical movement to that which is required to completely uncover the opening 80 at the lowermost position and to completely close the opening 80 at its uppermost position.

The float has a hole 88 through which water may be introduced into the float, the water varying the level at which the float closes the opening 80.

The float preferably has one or more interior bulkheads 89 whose upper and lower edges 90 and 91 are spaced respectively from the bottom and top of the float so as to permit water to flow into the float and distribute itself uniformly across the float.

The hollow sliding float of FIG. 5 is advantageous in providing ease of adjustment of the level of water in the gutter at which the float will close. That adjustment is achieved, as indicated above, by the addition of selected quantities of water to the float through the opening 88. Thus, it is possible to introduce greater amounts of water into the floats at the weirs which are more remote from the gutter outlet, thereby providing assurance of a greater flow of water into the gutters at those points, particularly during quiescent conditions, to provide the "downhill" flow of water from those remote points to the gutter outlets.

Additionally, the sliding float is easily adapted to the covering of a weir opening extending transversely through a conduit forming the inner wall of the gutter as disclosed in Ogden U.S. Pat. No. 2,932,397.

Figure 6:
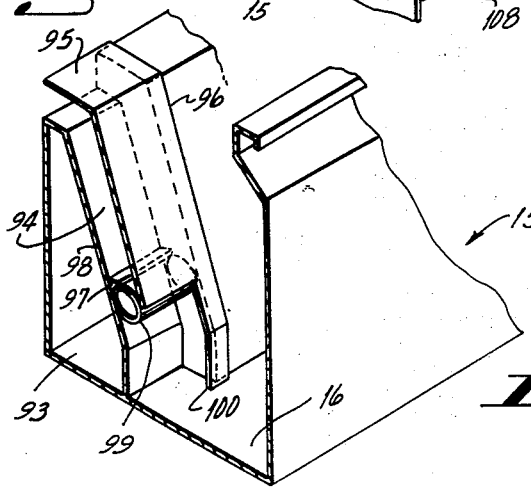
FIG. 6 is a perspective view of a third alternative embodiment.

Another form of the skimmer is illustrated in FIG. 6. In that form of the invention, the skimmer is applied to a gutter configuration of the type disclosed in Ogden U.S. Pat. No. 2,932,397. In that patent, the inner lip or wall of the gutter is formed by a conduit 92, with the remainder of the gutter being formed by the usual coping 15 to provide a gutter trough 16. The conduit 92 is recessed at 93 to form a part of a passageway 94 from the pool into the gutter 16. A generally L-shaped plate 95 overlies the recess 93 and is secured at its edges 96 to the conduit 90 to complete the formation of the passageway 94, the passageway forming the opening from the gutter 16 into the pool.

A triangular valve seat 97 is fixed at any suitable level on the inclined wall 98 of the recess 93 and extends completely across the length of the recess. A tubular float 99 is slidable within the passageway 94 and is engageable with the seat 97 to seal off the passageway and hence the opening from the pool into the gutter. The tubular float 99 will rise with the level of the water in the gutter and will seal off the passageway at a predetermined level, the predetermined level of the water in the gutter being determined by the vertical positioning of the valve seat 97.

A window 100 is formed in the plate 94 immediately below the location of the seat 97 to form an egress opening for the water passing from the pool through the passageway 94 past the float 99 and into the gutter.

The skimmer has been shown for use in connection with a steel wall pool. It should be understood that with modification well within the skill of the art the skimmer can be used in conjunction with a concrete pool, and it can be used in connection with an Ogden type pool in which the front wall of the gutter is formed by the conduit which delivers water to the pool. In either of those two types of pool, the front wall, be it the conduit or concrete, would simply have to be notched and a skimmer housing inserted within the notched portion.

Suction Operated Embodiment

Figure 7:
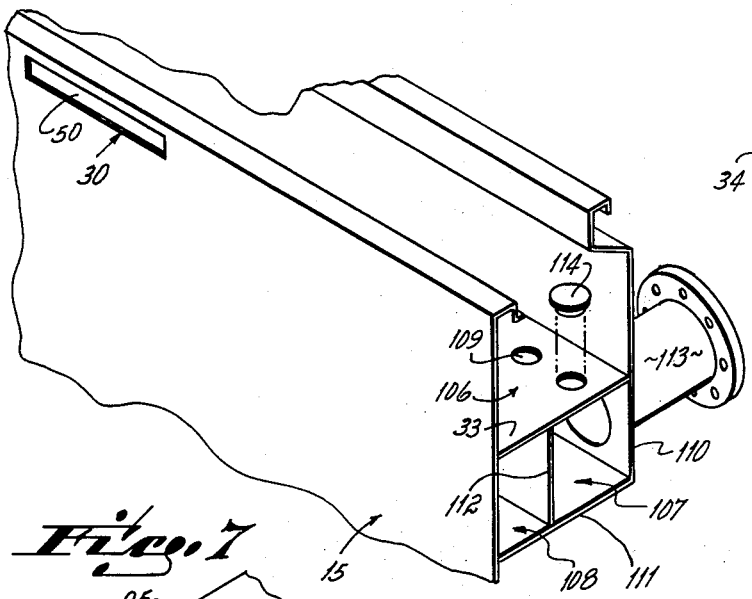
FIG. 7 is a perspective view of a section of a two stage gutter system.

The embodiment of the invention wherein the water is withdrawn from the gutter positively by connecting it to the suction or low pressure end of a pump is illustrated in FIG. 7. There, the gutter is illustrated at 106 and immediately below it is a return conduit 107. Water is delivered to the pool, as described above, through a wall formed conduit 108. The gutter 106 is also formed as described above with an inner wall 34, a bottom wall 33, a back wall 31 and a grating supported on angle members (neither of which is illustrated in this figure), all as described above. In this embodiment, however, the bottom wall of the gutter is common to the conduit 108 and is formed with a series of holes 109 spaced around the perimeter of the pool as shown in FIG. 8. The conduit 107 is formed by a vertical wall 110, a bottom wall 111 and a front wall 112 which in the illustrated embodiment is formed by the rear wall of the wall formed conduit 108. The gutter is connected by a pipe 113 to the low pressure side of pump in the filter system.

Stoppers or plugs 114 are adapted to be inserted into selected ones of the holes 109 spaced around the perimeter of the pool to block off the holes. The selective closing of the holes 109 permits the operator or installer to open a greater number of holes where the water tends to become deeper in usage, thereby maintaining a substantially uniform level of water in the gutter. This feature is desirable because of the wide variety of pool sizes, shapes, pump capacities and the like which make it preferable to determine empirically the best number and location of the holes 109 to achieve the desired uniformity.

This embodiment of the invention is preferably used with skimmers of the type described above so as to provide assurance that the upper section of the gutter will be continuously supplied with water in order to avoid sucking air into the pump.

In the operation of this embodiment, water is continuously supplied to the gutter 106 to keep it in a condition wherein the holes 109 are continuously covered. The pump continuously and positively draws water out of the conduit 107, the supply of water to the lower section being continuously replenished by water from the gutter.

The use of the suction evacuation of water provides assurance of sufficient gutter capacity to accommodate even the greatest conditions of activity in the pool while avoiding flooding of the gutter.

I claim:

1. In a swimming pool having generally vertical walls and a filter system adjacent said pool, a nonflooding perimeter gutter system for returning water from said pool to said filter system comprising, an open upper gutter section located adjacent the top of said vertical walls and extending around the perimeter of said pool and having an inner wall, a back wall and a bottom wall, said upper gutter section being operative to accommodate sudden water surges over said inner wall, a closed lower gutter section forming conduit around the perimeter of the pool adjacent said upper gutter section, said lower gutter section, at all times during operation, beingcompletely filled with water, means connecting said lower gutter section to said upper gutter section at a plurality of locations spaced around the perimeter of said pool, said connecting means providing passageways for the flow of water from said upper section to said lower section, a plurality of skimmer openings spaced around the perimeter of said pool and located in said inner gutter wall adjacent the top of said inner gutter wall, means independently and automatically closing each said opening, said closing means including a float located in said gutter and associated with each said opening, said float being located well below said skimmer openings but above said lower gutter section, and effecting the closing of said openings when the level of water in said gutter, lifting said float, rises to a level well below said opening and well above the level of said passageways in said second gutter section, said skimmer openings and said closing means continuously supplying water from said pool to said upper gutter section at locations spaced around the perimeter of said pool to maintain a constant flow of water to said lower gutter section above said passageways during both periods of quiescence and periods of greater pool activity, and suction means connected to said lower gutter section for positively withdrawing water therefrom and directing it to said filter system, thereby continuously withdrawing water simultaneously from all portions of said perimeter gutter through said plural passageways in order to maintain a constant flow of water in said gutters with a constant removal of water from said gutters, without relying on gravity flow to said filter system, thereby creating substantially uniform surge capacity around the perimeter of said pool, the maintenance of water in said upper section preventing air from flowing into said lower section and into said pump.

2. In a swimming pool having generally vertical walls and a filter system adjacent said pool, a nonflooding perimeter gutter system for returning water from said pool to said filter system comprising, an open upper gutter section located adjacent the top of said vertical walls and extending around the perimeter of said pool and having an inner wall, a back wall and a bottom wall, said upper gutter section being operative to accommodate sudden water surges over said inner wall, a closed lower gutter section forming conduit around the perimeter of the pool adjacent said upper gutter section, said lower gutter section, at all times during operation, being completely filled with water, means connecting said lower gutter section to said upper gutter section at a plurality of locations spaced around the perimeter of said pool, said connecting means providing passageways for the flow of water from said upper section to said lower section, a plurality of skimmer openings spaced around the perimeter of said pool and located in said inner gutter wall adjacent the top of said inner gutter wall, means independently and automatically closing each said opening, said closing means including a float located in said gutter and associated with each said opening, said float being located well below said skimmer openings but above said lower gutter section, and effecting the closing of said openings when the level of water in said gutter, lifting said float, rises to a level well below said opening and well above the level of said passageways in said second gutter section, said skimmer openings and said closing means continuously supplying water from said pool to said upper gutter section at locations spaced around the perimeter of said pool to maintain a constant flow of water to said lower gutter section above said passageways during both periods of quiescence and periods of greater pool activity, and suction means connected to said lower gutter section for positively withdrawing water therefrom and directing it to said filter system, thereby continuously withdrawing water simultaneously from all portions of said perimeter gutter through said plural passageways in order to maintain a constant flow of water in said gutters with a constant removal of water from said gutters, without relying on gravity flow to said filter system, thereby creating substantially uniform surge capacity around the perimeter of said pool, the maintenance of water in said upper section preventing air from flowing into said lower section and into said pump, and plugs inserted in selected ones of said passageways to make substantially uniform the level of water in said upper gutter section.

* * * * *